US006200049B1

(12) United States Patent
Pinhel et al.

(10) Patent No.: US 6,200,049 B1
(45) Date of Patent: Mar. 13, 2001

(54) COSMETIC DISPENSER AND METHOD

(75) Inventors: Joaquim José Lopes Pinhel, Guatire; José T. Calvo, Caracas, both of (VE)

(73) Assignee: Plastic-Envases, c.a., Guatire (VE)

( * ) Notice: Subject to any disclaimer, the term of this patent is extended or adjusted under 35 U.S.C. 154(b) by 0 days.

(21) Appl. No.: 09/526,934

(22) Filed: Mar. 16, 2000

(51) Int. Cl.[7] ..... B43K 21/08

(52) U.S. Cl. ..... 401/78; 401/80; 401/82; 401/86; 401/63; 401/74

(58) Field of Search ..... 401/78, 80, 74, 401/63, 61, 62, 75, 77, 82, 83, 84, 86, 87, 117, DIG. 1, DIG. 55

(56) References Cited

U.S. PATENT DOCUMENTS

| | | | | |
|---|---|---|---|---|
| 1,999,263 | * | 4/1935 | Thesmar . | |
| 2,999,585 | * | 9/1961 | Hultgren . | |
| 3,298,509 | * | 1/1967 | Hultgren . | |
| 3,380,795 | * | 4/1968 | Gruska . | |
| 3,653,776 | * | 4/1972 | Geisel . | |
| 4,750,501 | | 6/1988 | Ackermann et al. | 132/79 C |
| 4,812,066 | | 3/1989 | Gueret | 401/78 |
| 4,994,987 | * | 2/1991 | Holloway et al. | 401/78 |
| 5,174,673 | * | 12/1992 | Gruner | 401/78 |
| 5,186,560 | | 2/1993 | Holloway | 401/78 |
| 5,186,561 | | 2/1993 | Ackermann et al. | 401/78 |
| 5,324,126 | | 6/1994 | Holloway et al. | 401/78 |
| 5,560,727 | * | 10/1996 | Vaupel | 401/78 |
| 5,988,917 | * | 11/1999 | Sheffler et al. | 401/78 |

FOREIGN PATENT DOCUMENTS

| | | | | |
|---|---|---|---|---|
| 2629316 | * | 1/1978 | (DE) | 401/78 |
| 2143212 | * | 2/1985 | (GB) | 401/78 |

* cited by examiner

*Primary Examiner*—Henry J. Recla
*Assistant Examiner*—Khoa Huynh
(74) *Attorney, Agent, or Firm*—Jack E. Dominik

(57) ABSTRACT

A cosmetic dispenser having a decorative shell, and a cap which normally snap fittingly engages the upper portion of the body. Interiorly there is a spline tube having a pair of opposed vertical tracks terminating in an upper catch and a lower catch. A riser cup is provided with a plurality of circumferentially downwardly spaced legs which deflect outwardly to resiliently engage the interior portion of the spline tube. A relaxation taper at the lower portion of the spline tube receives the depending legs from the riser cup and thereby lets them expand to a relaxed condition in which condition they will retain their set. At the opposed portion of the motion, when the cup is near the top, provision is made for windows which are short vertical slots in the cup and in coordinated relationship with the helical track so that at the upper portion of its motion the helical cup legs rest either in the vertical track of the spline tube or in the windows. The method is primarily directed to assembling the dispenser so that the riser cup is in the up position after manufacture to thereby permit the riser cup legs to float freely. Similarly, a relaxed taper is at the bottom of the spline sleeve for the legs to set without restraint after the cosmetic is filled in the unit, and after its usage by the customer.

7 Claims, 4 Drawing Sheets

COSMETIC DISPENSER AND METHOD

FIELD OF THE INVENTION

The present invention relates to cosmetic dispensers and a method for preserving the functions due to plastic deflection and deformation. The subject matter is generally found in U.S. Classification 401, Subclass 78 and 80.

BACKGROUND OF THE INVENTION

Conventional cosmetic dispensers, particularly those used for lipstick, have a multi-element construction. The exterior portion is often times a decorative shell with a cap. Interiorly, provision is made for a tube having a spline slot, a helical sleeve having and internal helix, and a riser cup in which the lipstick or other cosmetic is seated. The riser cup has legs which expand between the top and bottom of the strokes. The legs or projections are provided to simulate a click so that the users have an audible as well as physical feeling when the upper position and the lower position are attained.

A problem arises after the containers are manufactured, and before they are filled with the desired cosmetic in avoiding developing a permanent set in the expandable members that provide the friction as the cup is raised and lowered, and which lock the contents at the upper and lower position or firmly preclude the same from moving at an intermediate position. If the dispensers, after they are manufactured, and the expandable portions are in a restrained condition for one month or less prior to using, they develop a set which severely impedes expansion and therefore the friction and the clicking action of the top and bottom.

Even after the dispenser is filled with the desired cosmetic, if the user, after half of the cosmetic has been consumed, does not lower the cup to the lower most position the expandable member can be similarly induced to take a set and diminish its function.

Attempts have been made at developing a relaxation zone for such expandable members, as shown in U.S. Pat. No. 5,324,126. Other patents in the prior art include U.S. Pat. No. 5,186,561 and U.S. Pat. No. 4,750,501 and the prior art recited in all of those patents.

What is needed is a construction which provides for a relaxation zone of the expandable members relating to the movement of the cup in both the upper position and the lower position. Moreover, it is additionally important for utilizing the relaxation at the top and the bottom in the 80/20 piece lipstick mechanism.

SUMMARY OF THE INVENTION

The present invention relates to a dispenser, primarily for cosmetics but also applicable for medication of chapped or cracked skin, having a shell, usually decorative, and a cap which normally snap fittingly engages the upper portion of the body. Interiorly there is a spline tube having a pair of opposed vertical tracks terminating in an upper catch and a lower catch. The riser cup is provided with a plurality of circumferentially downwardly spaced legs which deflect outwardly to resiliently engage the interior portion of the spline tube. Follower pins are provided diametrically opposed and extending outwardly from the riser cup to engage the helical track in the helical sleeve. Characteristic of the invention is the provision of a relaxation taper at the lower portion of the helical sleeve which is of larger diameter than the balance of the interior portion so that it can receive the depending legs from the riser cup and thereby let them expand to a relaxed condition in which condition they will retain their set. At the opposed portion of the motion, when the cup is near the top, provision is made for windows which are short vertical slots in the cup and in coordinated relationship with the helical track so that at the upper portion of its motion the helical cup legs rest either in the vertical track of the spline tube or in the windows. In this position of relaxation, while the riser cup is in the up position, the depending legs are permitted to relax as well and thereby not lose the cantileverly spring outward relationship to the bottom of the cup. The invention may also place windows, i.e. short vertical slots, at the lower portion of the spline tube either in place of or in addition to the similar windows discussed above in order to allow the depending legs to relax while the cup is at or near the lower portion of its motion. Similar windows may also be placed at other locations of the helical sleeve so as to allow the depending legs to relax when the riser cup is at the associated position.

Important to the method is providing a cosmetic dispenser having as interior operative members a spline tube, a helical sleeve, and riser cup with depending cantileverly outwardly deflecting legs. In accordance with the method, after manufacture of the cosmetic dispenser, the cup is at the top when it is delivered from the dispenser manufacturer to the cosmetic manufacturer. At all times thereafter, the cantilever legs are permitted to relax and do not take a deflective set. When the cosmetic manufacturer decides to fill the container, the legs are still in a relaxed position. After the filling, the cup is positioned at the lower position, but there again the legs remain relaxed. Thereafter, when the consumer uses the product, it will continue to maintain its drag effect, and the click feel audible both at the top and the bottom. This is designed to encourage the user to lower the cup to the bottom relaxed position when finished with applying the cosmetic so that even during the retention period by the consumer while the cosmetic is consumed the legs will be permitted to relax and thereby retain their yieldable effect.

In view of the foregoing, it is a primary object of the present invention to provide a cosmetic dispenser which permits the same to be stored in a relaxed configuration of the yieldable members on the cup which otherwise engage the interior portion of the spline tube to provide for friction, and locking at the top and the bottom. Offset pins on the cup engage the helical track inside the helical sleeve to rotate the cup and elevate the same to an upper position sufficient so that enough of the cosmetic extends outside the helical sleeve for application by the user.

A further object of the present invention is to provide a cosmetic dispenser which can be shipped with the cup and its legs in a relaxed configuration, and stored for lengthy periods of time in that configuration whereby a deflective set is taken by the cantilever legs. Conversely, even after the dispenser is filled, the provision for a zone of relaxation at the top and the bottom makes possible the prolongation of the resilient life of the legs for a significant period of time than might be expected.

Yet another and important object of the present invention is to provide an interior operable structure which can be used in the so-called 80/20 one piece cosmetic dispenser mechanism by simply using collapsible cores.

A further object of the present invention is to stabilize the cup at the top and the bottom to minimize wobbling. In the same fashion, inadvertent back off is inhibited.

There is a distinct click sound when the subject cup reaches the top which warns the user against forcing the cup further out of its track when it reaches the top or the bottom, and there is a feeling that the cup has reached "its place" at either extremes of its movement.

The objective of the present invention is a significant improvement over U.S. Pat. No. 5,324,126 which fails to accommodate the 80/20 one piece mechanism due to the aesthetic conditions of the product dictated by the subject patent, whereas as to the Applicant the interior portion of the spline tube is enlarged to accommodate the flexing legs.

A key object of the method of the present invention is to provide for the audible signal at both the top and the bottom of the track of the cup and as a concomitant the manufacturer of the mechanism places it in the upper relaxed position for shipment to the cosmetic manufacturer who, in turn, continues to store the same prior to filling with the cup in the upper position. Desirably in accordance with the method, prior to filling with the cosmetic, the cup is lowered to its lowest relaxed position and retained in that position until sold to the consumer or end user.

DESCRIPTION OF THE ILLUSTRATIVE DRAWINGS

Further objects and advantages of the present invention will be appreciated taken in conjunction with the accompanying illustrative drawings in which.

DESCRIPTION OF THE ILLUSTRATIVE EMBODIMENT

Figure 1:
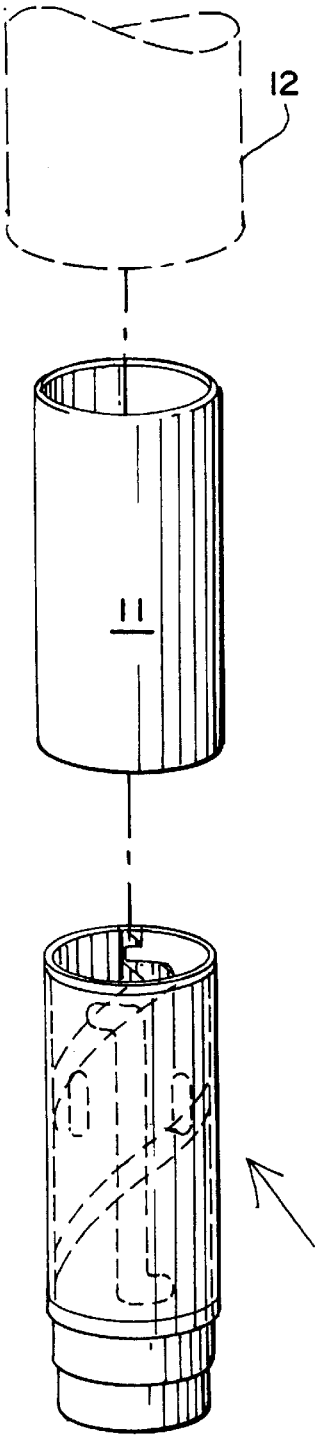
FIG. 1 is a front perspective showing in broken lines the interior portions of the assembled member and in an exploded fashion a housing.
Figure 2:
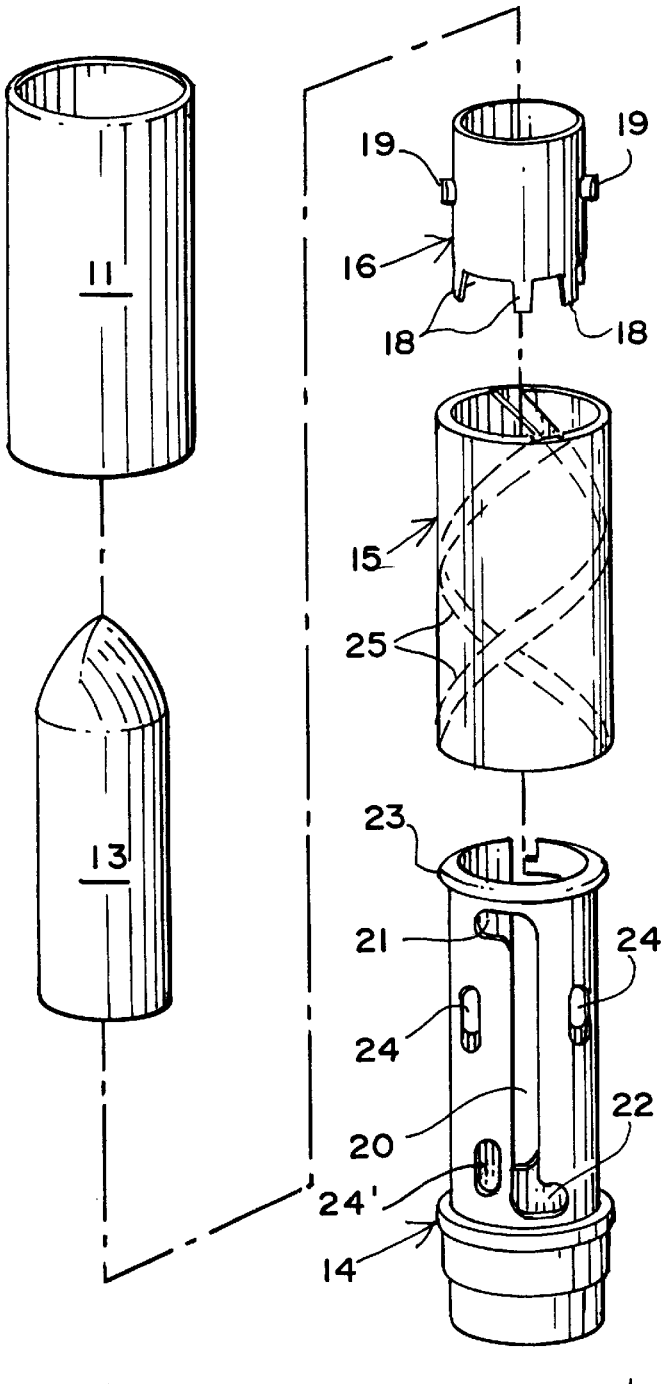
FIG. 2 show the three operative members, namely, the spline tube, the helical sleeve, and the riser cup in exploded relationship and further exploded to relate to the decorative shell and cap of the exterior housing.

Turning now to FIGS. 1 and 2, it will be seen that the subject cosmetic dispenser 10 includes a decorative shell 11 and a cap 12. The decorative shell may be made of metal, and in practice is usually made of aluminum and referred to as an "A" shell. It is obvious that a decorative shell made of any suitable material may be equally effective in this application. The interior portions, as shown in exploded view in FIG. 2, are the spline tube 14, the helical sleeve 15, and the riser cup 16. Extending downwardly from the riser cup 16 are the outwardly extending cantileverly disposed legs 18 which engage the interior portion of the helical sleeve 15, and are propelled upwardly and rotatively by the follower pins 19 which engage the helical track 25 of the helical sleeve 15. The pins also simultaneously engage the vertical track 20 and then move leftwardly or rightwardly into the upper catch 21 or the lower catch 22.

Figure 3:
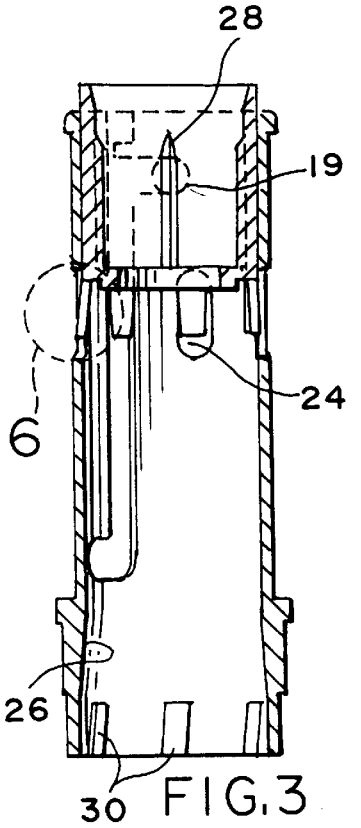
FIG. 3 is a view of the riser cup inside the spline tube with the legs or fingers of the riser cup in the relaxed position in the upper section of the inner body.

At the upper position, particularly as shown in FIG. 3, provision is made for a plurality of opposed windows 24 to receive the lower portion of the legs 18, the windows 24 being provided in the spline tube 14 and in uniform radially spaced relationship with the vertical track 20 to the end that six areas for relaxation at the upper position of the riser cup 16 are provided for the six outwardly predisposed legs 18 of the riser cup 16.

At the lower portion of the motion, an undercut relaxation taper 26 is provided in the spline tube 14 so that when the riser cup 16 reaches its lowest position, the legs 18 will deflect outwardly into the subject relaxation taper 26 and thereby relax and retain their deflected position against any effort to form a deflective set in the legs 18. Alternative embodiments may also place opposed windows 24', similar to the windows 24 that are shown in FIG. 2, at the lower portion of the spline tube 14 so as to allow the legs 18 to further relax when the riser cup 16 is in it's lower position. Windows 24' at the lower portion of spline tube 14 may be used either in addition to the windows 24 shown in FIG. 2.

Figure 5:
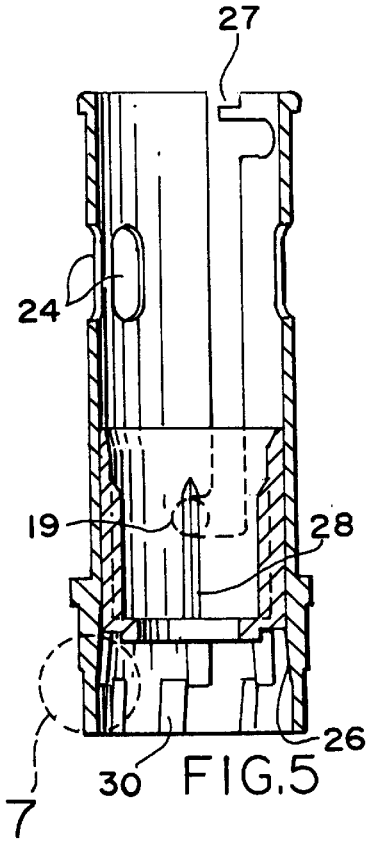
FIG. 5 is a view of the riser cup inside the spline tube with the legs in the relaxed position in the lower section of the spline tube.
Figure 6:
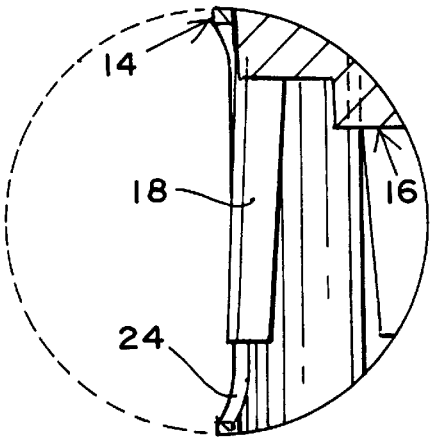
FIG. 6 is a detailed view of FIG. 3.

In greater detail, it will be seen that a lock ring 23 is provided at the upper portion of the spline tube 14 for co-acting engagement with the upper portion of the helical sleeve 15. There shown in engaged relationship in the upper portion of FIG. 3. FIG. 3, in conjunction with the detail shown in FIG. 6, also shows how the legs 18 of the riser cup 16 engage partially in the windows 24. Also to be noted, particularly in FIG. 5, is the lock ring gap 27 which permits partially closing the upper end of the spline tube 14 for ease of insertion into the helical sleeve 15. The retaining ribs 28, which are formed interiorly in the riser cup 16 help to secure the cosmetic 13.

Figure 4:
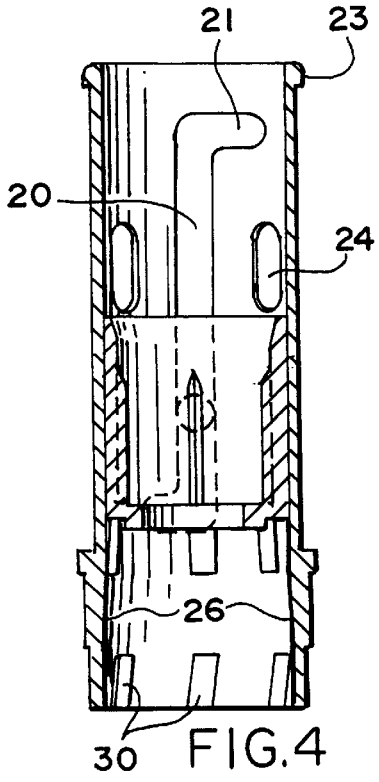
FIG. 4 is a view of the riser cup inside the spline tube, with the legs of the riser cup in the unrelaxed position. In this position, the cup can go up and down the longitudinal tracks without the legs getting caught on any part of the windows or the longitudinal track.
Figure 7:
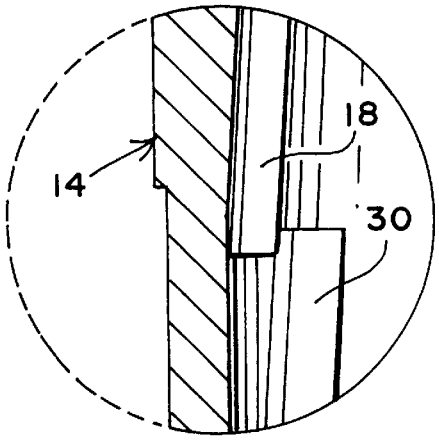
FIG. 7 is a detailed view of FIG. 5.
Figure 8:
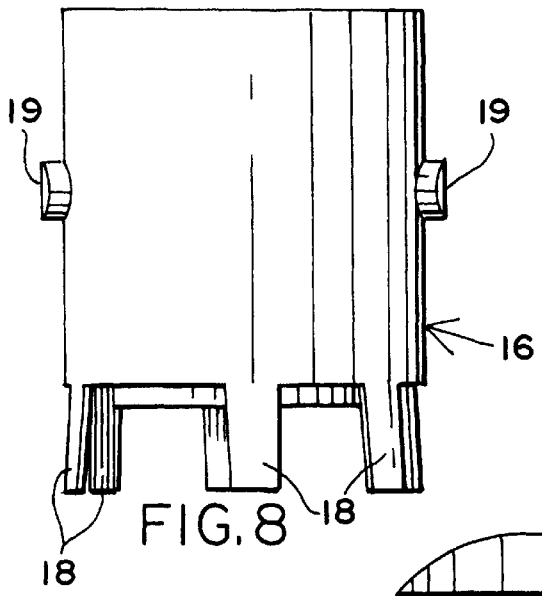
FIG. 8 is a frontal (with respect to the longitudinal track of the spline tube) view of the riser cup showing the angle of the legs (with an interference that could be between 0.008" to 0.020"), which results in the flexible friction within the spline tube.
Figure 9:
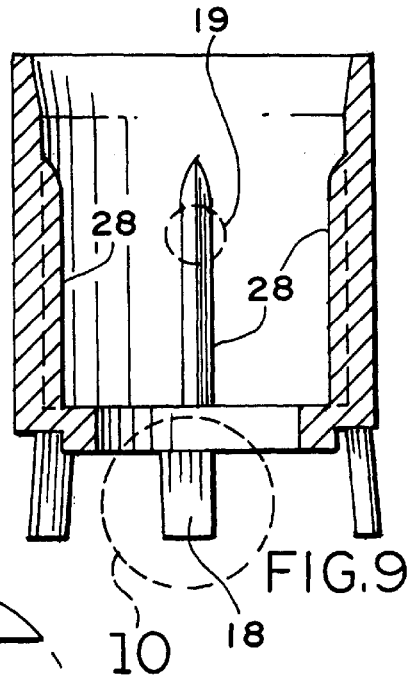
FIG. 9 is a lateral (with respect to the longitudinal track of the spline tube) view of the riser cup showing the longitudinal conicity on one side of the legs which facilitates the relaxed legs to disengage from the windows and the longitudinal track.
Figure 10:
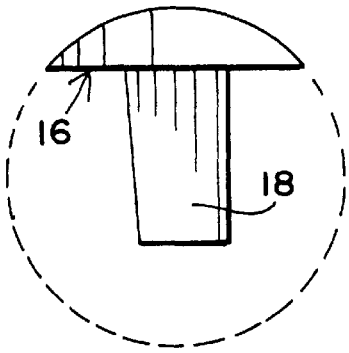
FIG. 10 is a detailed view of the shape of the legs.
Figure 11:
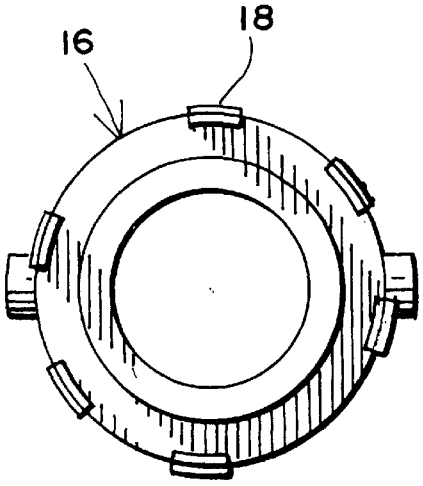
FIG. 11 is a bottom view of the riser cup.
Figure 12:
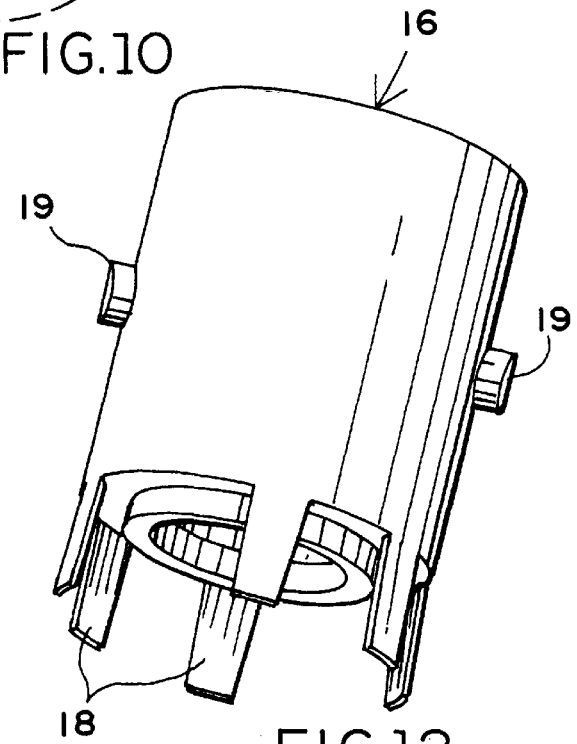
FIG. 12 is a view of the riser cup.
Figure 13:
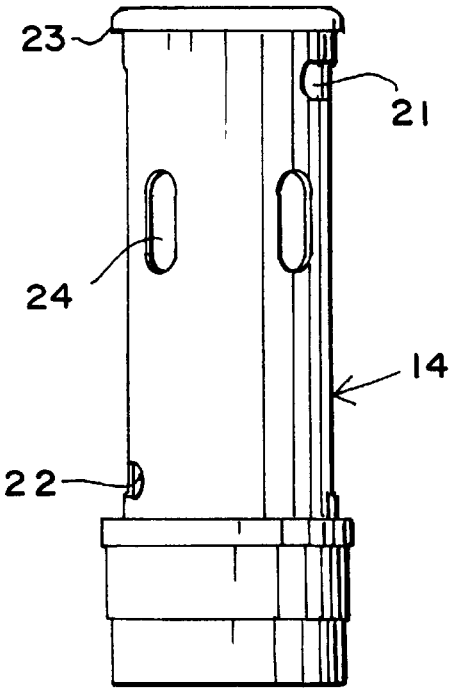
FIG. 13 shows a side view of the spline tube.
Figure 14:
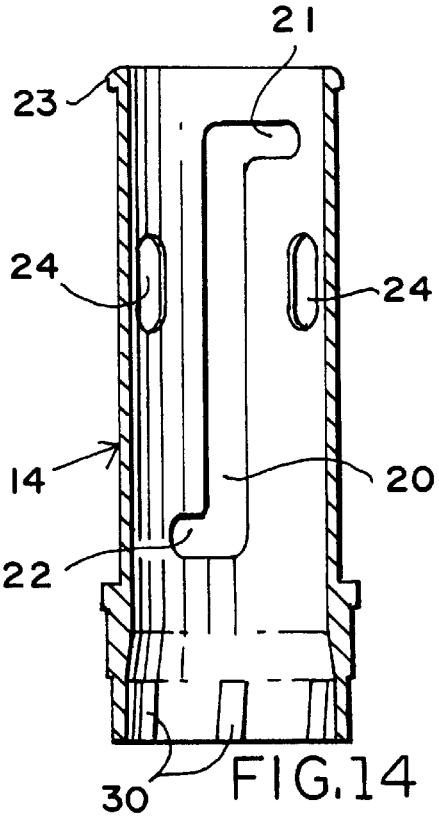
FIG. 14 shows another side view of the spline tube.
Figure 15:
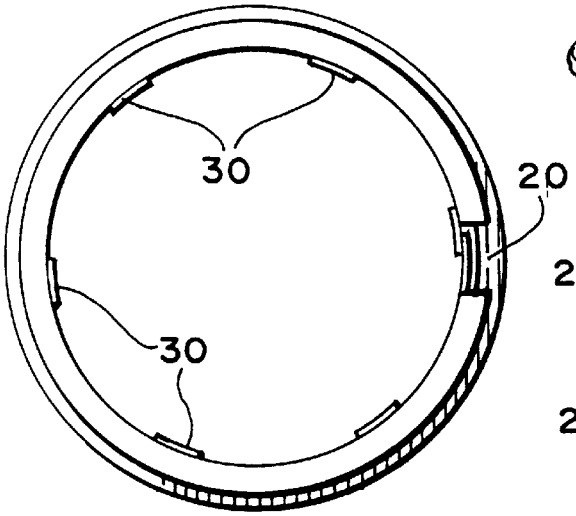
FIG. 15 is a top view of the spline tube.
Figure 16:
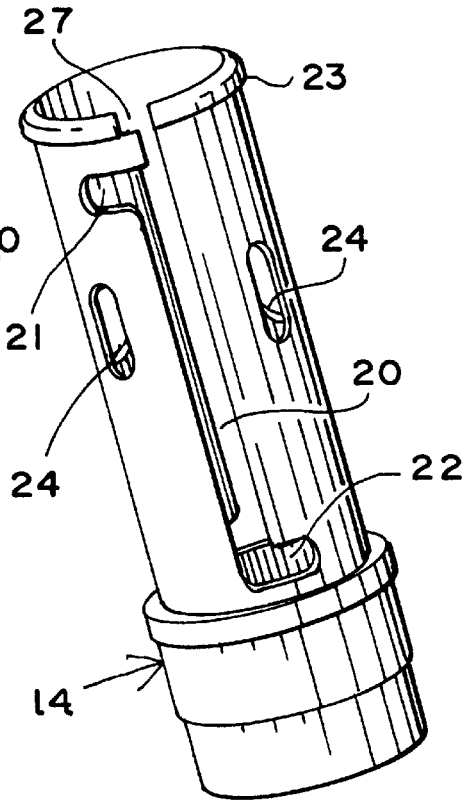
FIG. 16 shows a third side view of the spline tube.

Finally, in accordance with the desirability of giving the user both a tactile and an audible signal when the riser cup 16 is at its extremes, provision is made for click cams 30 at the lower portion of the spline tube 14, as shown in FIGS. 3, 4 and 5. The click cam is also shown in a different elevation in FIG. 7 where its relationship to the spline tube 14, and cup legs 18 is also shown. Additionally, the retaining ribs 28 are shown in FIG. 9. FIG. 9 also shows that the legs 18 of the riser cup 16 are canted outwardly for frictional engagement as they rise up and down the interior portion of the spline tube 14.

The method of the invention is directed to the sequencing of the manufacture, storage, filling, storage, and ultimate use of the subject lipstick container 10. When the three basic parts are manufactured, namely the spline tube 14, the helical sleeve 15, and the riser cup 16, they are assembled in such a way that the legs 18 of the riser cup rest in the upper position where they either penetrate the relax windows 24, or the vertical track 20 of the spline tube 14. After inserting the cosmetic 13, the riser cup 16 is moved to the lower position from the upper position as sequentially shown in the upper position in FIG. 3, a mid-position in FIG. 4 and a bottom position in FIG. 5. In FIG. 5, in particular, it will be seen how the legs 18 of the riser cup 16 co-act with the click cams 30 at the bottom portion of the stroke of the riser cup 16. After the cosmetic container 10 has been filled, the riser cup is then positioned at the lower portion of its travel, as shown in FIG. 5. In that configuration, it will be seen that the legs 18 of the riser cup 16 are permitted to relax, particularly as shown in the bullet section of FIG. 5 as expanded in FIG. 7. Similarly, the legs 18 are permitted to expand through the windows 24 in the upper position, as shown by the bullet section of FIG. 3 expanded into FIG. 6.

It will be understood that various changes in the details, materials and arrangements of parts, or method which have been herein described and illustrated in order to explain the nature of the invention, may be made by those skilled in the art within the principle and scope of the invention as expressed in the appended claims.

What is claimed is:

1. A cosmetic dispenser comprising, in combination, a cylindrical spline tube;

a helical sleeve proportioned to surround the spline tube;

a riser cup proportioned to raise and lower inside the combination of the spline tube and helical sleeve;

said riser cup having a plurality of depending legs cantileverly secured thereto and extending downwardly therefrom;

a follower pin on the riser cup for raising and lowering the same;

a vertical track inside the spline tube;

a helical track inside the helical sleeve;

said follower pin being formed in proportion to simultaneously engage the vertical track and the helical track to thereby raise and lower the riser cup by rotating the interior spline tube in relation to the helical sleeve;

a recess taper located at the lower portion of the spline tube for receiving the depending legs from beneath the riser cup to thereby relieve any strain on such legs in the resting position at the lower portion; and a plurality of relax windows located near the top of the spline tube and spaced along the circumference of the spline tube proportioned to receive the lower legs of the riser cup when the riser cup is near the top of its travel;

whereby the riser cup legs are received in a relaxed condition in said recess taper at the bottom of the movement of the riser cup and at the top of the movement of the riser cup in said windows to thereby relieve any strain on the same when shipped from the manufacturer, when stored by the cosmetic supplier, and then after the cosmetic is inserted and prior to use by the user.

2. The cosmetic dispenser according to claim 1, wherein said relax windows are located near the bottom of the spline tube so as to receive the legs of the riser cup when the riser cup is near the bottom of its travel.

3. The cosmetic dispenser according to claim 1, wherein said relax windows comprise two sets of relax windows, wherein the first set is located near the top of the spline tube and the second set is located near the bottom of the spline tube so as to receive the legs of the riser cup when the riser cup is either near the top or near the bottom of its travel.

4. In the cosmetic dispenser according to claim 1, said depending legs being even in number and spaced at even radials each from the other;

said windows being spaced at even spacing from a pair of each and from the termination of the helical track member;

whereby a uniform distribution of relief and frictional engagement may be achieved by the legs.

5. The method for forming a cosmetic dispenser comprising a spline tube having an interior vertical spline cut, a helical sleeve having an interior helical cut, and a riser cup for containing a cosmetic, the improvement comprising:

forming a plurality of legs in the underneath portion of the riser cup which legs are proportioned to yieldably engage the side wall of the spline tube, providing a plurality of opening adjacent the upper portion of the spline tube for receiving the legs of the cup in a relax configuration; and forming a relaxed recess taper in the lower portion of the spline tube for receiving the lower ends of the yieldable legs;

whereby a relaxed condition of the otherwise yieldably loaded legs is provided at both the top and the bottom of the movement of the cup.

6. A cosmetic dispenser comprising, as its operative interior elements, a spline tube having at least one vertical track;

a helical sleeve having an interior helical track extending essentially to the top of the unit, but in spaced relationship to the bottom;

a riser cup having at least a follower pin proportioned to engage the interior track of the helical sleeve which helical sleeve is exterior to the spline tube;

a plurality of legs flexingly expanding from the lower portion of the riser cup;

said spline tube and helical sleeve confining the riser cup for movement between an upper position and a lower position;

a plurality of windows for receiving the legs of the riser cup at the upper position of the riser cup; and an undercut relaxation taper to receive the legs of the riser cup at the lower position of the riser cup, whereby the legs of the riser cup, when not in operation and positioned at the upper position or the lower position, are relaxed against confinement tending to impose a permanent deflection upon the legs.

7. The cosmetic dispenser according to claim 1 wherein said plurality of windows is located in the lower part of the spline tube.

* * * * *